US006074267A

United States Patent [19]

Plow

[11] Patent Number: 6,074,267

[45] Date of Patent: Jun. 13, 2000

[54] SINGLE LINE WIND-DRIVEN FLYING TOY

[76] Inventor: Gregory M. Plow, 10265 Lucky Ct., Gilroy, Calif. 95020

[21] Appl. No.: 09/126,097

[22] Filed: Jul. 30, 1998

Related U.S. Application Data

[63] Continuation-in-part of application No. 08/625,338, Apr. 1, 1996, Pat. No. 5,803,784.

[51] Int. Cl.[7] ..... A63H 29/10; A63H 33/40; A63B 37/00

[52] U.S. Cl. ..... 446/176; 446/217; 446/228; 446/490; 473/575

[58] Field of Search ..... 446/34, 61, 66, 446/68, 176, 217, 218, 228, 489, 490; 244/153 R, 155 R, 153 A; 473/575

[56] References Cited

U.S. PATENT DOCUMENTS

| | | | |
|---|---|---|---|
| 454,804 | 6/1891 | Murphy | 446/217 |
| 1,087,306 | 2/1914 | Lodge | 446/176 |
| 1,323,112 | 11/1919 | Sochurek | 446/228 |
| 1,351,075 | 8/1920 | Trautman | 446/228 |
| 2,946,544 | 7/1960 | Kinney | 224/155 R |
| 3,596,857 | 8/1971 | Battles | 244/155 R |
| 3,848,835 | 11/1974 | Browning et al. | 244/155 R |
| 3,968,948 | 7/1976 | Schmidt | 255/155 R |
| 4,084,102 | 4/1978 | Fry et al. | 244/153 R |

*Primary Examiner*—D. Neal Muir
*Attorney, Agent, or Firm*—Peter A. Borsari

[57] ABSTRACT

A wind driven flying toy comprising a single guideline and an aerodynamic body slidably secured to the guideline, the aerodynamic body being capable of traversing the entire length single guideline in both directions by reacting with the action of wind power member even when the wind power is in a constant wind direction. The direction of the travel of the aerodynamic body can be modified by adjusting the orientation of the aerodynamic body and is not dependent upon a change in the direction of the wind. In addition, the direction of travel of the aerodynamic body along the single guideline can be reversed by rotation of a handle connected to the end of the guideline when the aerodynamic body is in contact with the handle. The aerodynamic body can take a variety of forms, including that of a unitary structure provided with apertures for slidably securing it to the guideline, a sail structure sail element having eyelets or guidetubes for slidably securing to the guideline, or the aerodynamic body can include a sail structure having a sail element secured to a frame element. The flying toy can also be automated by connecting rotating devices to the ends of the guideline.

33 Claims, 5 Drawing Sheets

SINGLE LINE WIND-DRIVEN FLYING TOY

RELATED APPLICATION

This application is a continuation in part of U.S. patent application Ser. No. 08/625,338, filed Apr. 1, 1996, now U.S. Pat. No. 5,803,784 and claims the benefit of priority therefrom.

FIELD OF INVENTION

The present invention is directed to flying toys, particularly to wind driven flying toys which use guidelines and more particularly is directed to a wind driven flying toy which uses only a single guideline and which is capable of reversing direction of travel along the guideline by modifying the orientation of the flying toy's sail structure with respect to the guideline. More specifically, the present invention is directed to a wind driven flying toy comprising at least a sail structure slidably secured to a single guideline.

BACKGROUND OF THE INVENTION

The prior art is replete with numerous toys and flying apparatus which have been developed for fun and entertainment, educational purposes and competition. Flying toys attached to strings, including for example, kites, have been used and enjoyed for centuries. More recently, a number of aerodynamic toys designed to be thrown in the air for use in throwing games have become very popular. For example, U.S. Pat. No. 3,359,678 shows a flying saucer; U.S. Pat. No. 3,976,295 shows a tethered disc enabling retrieval if the disc does not return back to the operator in the course of its flight; U.S. Pat. No. 4,516,946 shows a flying disc construction having an annular roller bearing at its center; and U.S. Pat. No. 4,802,875 shows a tethered flying disc with a two-piece bearing for control of the disc on a support line.

A number of kite string toys and flying devices have been described in prior art, representative examples of which include U.S. Pat. Nos. 1,172,198, 2,041,233 and 3,752,424. All of these devices require manual reset before the device can re-climb the kite string before the dive down action. U.S. Pat. No. 4,805,853 provides a modification of this type of device by having means to adjust elevator tabs at the rear wing tips of the device and includes a parachute launching mechanism.

Another genre of prior art flying toy using guidelines is disclosed in U.S. Pat. No. 518,931 wherein a toy is shown in which the inclination of the guidelines can be reversed. Similarly, U.S. Pat. No. 2,388,513 shows the use of a line connected to a toy air plane to affect the release of toy bombs; U.S. Pat. No. 3,838,855 discloses a toy air plane carried by a support line connected to a fixed reel; and U.S. Pat. No. 4,522,605 shows a toy operable over an inclined guideline extending between two fixed supports and runs over a fixed support eye to a freely held reel with hand extensions.

The prior art "kite climber" or "string climber" devices are flying elements that travel along a kite string from the operator's end to the kite under the action of wind power and then return back to the operator by gravity. These devices are powered by the wind in only one direction given constant wind conditions and constant operator position. In addition, these devices only "climb" the kite string by wind action, thereby affording only one direction of travel by reacting with the wind; direction in the opposite direction, to the operator's end, is provided by designing the device to collapse and fall back down the kite string due to natural gravitational pull. Further, the orientation of such a device as it travels up the kite string is fixed at 90° during its wind powered climb. Thus, these "kite climbers" are only wind powered in a first direction, must be designed to collapse in order to "travel" in a second direction by gravitational pull, and require that the sail element be oriented at a fixed 90° angle with respect to the kite string in order to react with the wind during its wind powered climb.

Another example of a flying toy is disclosed in U.S. Pat. No. 3,893,256 to Wolf et al. which provides a flying toy, such as an airplane, which is suspended from a sleeve through which pass a pair of filaments or guidelines. One pair of the filament ends is secured to a wall, while the other pair of filament ends is held by the user at a level below the wall attachment. In operation, the flying toy is motivated away from the user and towards the wall by moving the filaments apart and away from each other. The Wolf et al. flying toy is provided with a weighted front end and is dependent upon "free" rotation such that after it climbs the filaments, gravity pulls the weighted front end of the plane to swivel it 180° so that it falls back down the guidelines due to the earth's gravitational pull.

More recently, the present inventor has developed a new flying toy, referred to as a "windblade" which is disclosed in U.S. Pat. No. 5,259,804 and U.S. patent application Ser. No. 08/625,338 to Plow et al. The original "windblade" requires two guidelines for stabilization about which a sail structure has a fixed or locked orientation with respect to the guidelines as it travels in both directions along the guidelines by reacting with the power of the wind, rather than by the power of the wind. In this manner, the wind energy is transformed into a forward kinetic energy of the "windblade". The original windblade and the single line embodiment disclosed in this present application, differs significantly from prior art devices, such as the Wolf et al. flying toy. For example, the "windblade" sail structure, while its orientation is adjustable, does not freely swivel with respect to the guideline(s) while reacting with the wind during travel, the orientation being in the range of 10° to 60°. The sail structure reacts with the wind power to motivate along the guideline(s), rather than freely swiveling in the wind to align in the same direction as the wind direction.

Despite the teachings of the prior art, a need still exists for a flying toy which uses only a single guideline and which is capable of travel in both directions along the guideline. Utilization of only a single guideline in place of the previous dual guidelines will significantly enhance the ease of play for young children and reduce manufacturing costs. Such a flying toy should be designed in such a manner that simple adjustment of the orientation of it's sail structure with respect to the guideline enables it to reverse direction. In addition, such a flying toy should be inexpensive to manufacture, simple to assemble and disassemble and easy and fun to operate.

SUMMARY OF THE INVENTION

Accordingly, it is an object of the present invention to provide a flying toy having an aerodynamic body comprising at least a sail structure slidably secured to a single guideline which is capable of traveling along the guideline in both directions.

It is another object of the present invention to provide a flying toy wherein reversal of travel along its single guideline is accomplished by adjusting the orientation of the sail structure with respect to the guideline.

It is a further object of the present invention to provide a flying toy having an aerodynamic body which is capable of traversing its guideline when the direction of the wind is approximately perpendicular to the direction of the travel of the aerodynamic body along the guideline.

It is an additional object of the present invention to provide a flying toy wherein the operating pitch of the sail structure with respect to the guideline can be oriented to an angle in the range of about 10° to about 60°.

It is still another object of the present invention to provide a flying toy wherein the sail structure includes a frame element and a sail element.

It is yet another object of the present invention to provide a flying toy which is inexpensive to manufacture and simple to assemble and disassemble.

It is a further object of the present invention to provide a flying toy having articulating connection means to enhance stability of the aerodynamic body.

It is an additional object of the present invention to provide a flying toy having stabilization means.

It is an additional object of the present invention to provide a flying toy which is easy and fun to use and can be used by one or more operators.

It is still another object of the present invention to provide a flying toy that is capable of operation in an automatic mode and which can be used as either a novelty item or as a device for deterring birds from a garden, vineyard or orchard.

Additional objects, advantages and novel features of the invention will be set forth in part in the description which follows, and in part will become apparent to those skilled in the art upon examination of this specification or may be learned by practice of this invention.

To achieve the foregoing and other objects and in accordance with the present invention as embodied and broadly described herein, a high-speed and smooth-gliding flying toy is provided comprising at least an aerodynamic body slidably secured to a single guideline and which is configured in such a manner that the aerodynamic body is capable of traversing the guideline in both directions. The inventive flying toy, which either can be used by one or more operators, or can operate in an automatic mode, can reverse its direction of travel or flight along the single guideline by modifying the orientation or pitch of the sail structure with respect to the guideline.

DETAILED DESCRIPTION

Figure 1:
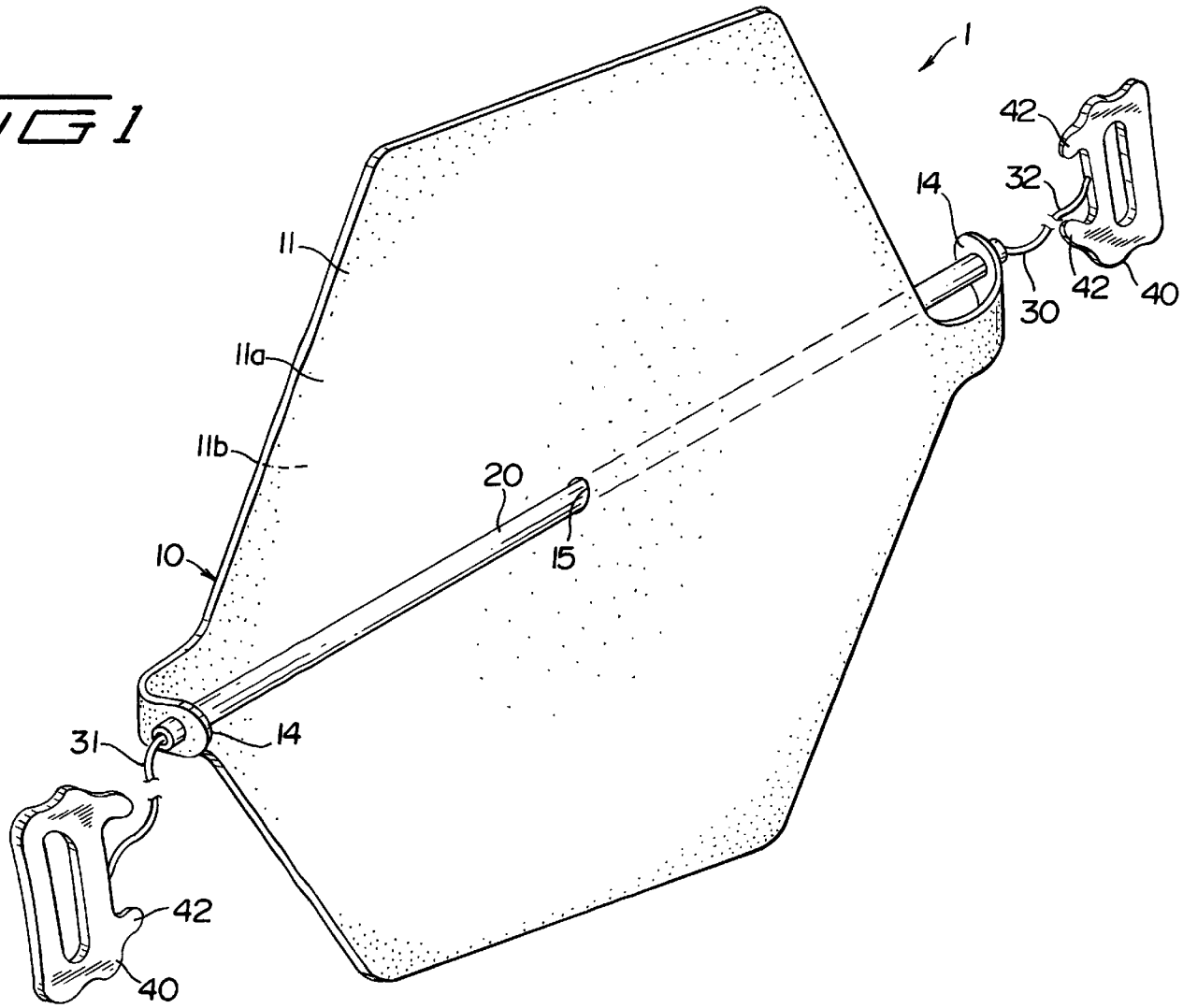
FIG. 1 is a front perspective view of the flying toy of the present invention.

The flying toy of the present invention comprises an aerodynamic body 1 slidably secured to a single guideline 30 as illustrated in FIG. 1. Aerodynamic body 1 includes a sail structure 10 and securing means 20 which slidably secures and retains the sail structure at a fixed angle or pitch with respect to the guideline during travel along the guideline 30. In the embodiment shown in FIG. 1, the sail structure is a one-piece structure in the form of a sail element 11. The sail element 11 may be composed of any suitable material capable of being wind-driven and holding an aerodynamic shape while reacting with the wind in the absence of a supporting frame, suitable examples of which include cardboard, fibre board, plastic, balsa wood, molded foam, foam sheeting and like materials characterized as being light-weight and having sufficient rigidity to retain an aerodynamic shape while reacting with the wind. Preferably the sail element in this embodiment is composed of a foam sheeting. In an alternative (not shown) the sail structure may be in the form of an air filled structure. As will be obvious to those skilled in the art, such air-filled structures, which are configured in a variety of shapes and forms and utilize air pressure to maintain the desired shape and form, provide the required degree of rigidity for use in the present invention. In this embodiment, other materials may be used, including for example mylar, vinyl, rubber and the like, to form the air-filled structure.

Any type of securing means 20 which enables the sail structure 10 to be slidably secured to the guideline 30 is contemplated for use in the present invention. Examples of suitable securing means include for example, guidetubes (elongated tubular elements), eyelets protruding from the sail structure, and apertures integrally formed within the aerodynamic body. For purposes of facilitating an understanding of the present invention, the securing means 20 hereinafter sometimes may be referred to as the guidetube 20. However, it is to be understood that the securing means can be any means which slidably secures the sail structure to the guideline.

Figure 3:
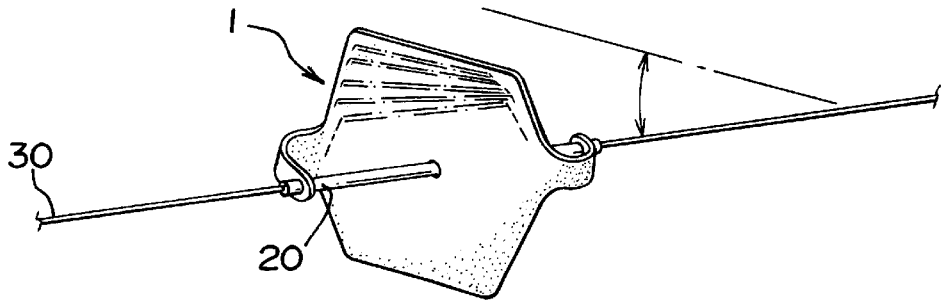
FIG. 3 is a perspective view of the flying toy of the present invention showing the range of orientation or pitch of the sail structure with respect to the guideline as it would travel in a first direction.

The guidetube 20 is connected to the sail element 11 in such a manner that it extends across the sail element and through an opening 15 disposed within the sail element. Preferably, the sail element 11 is formed with two complementary projections 14 extending from opposing ends thereof as illustrated in FIG. 1, each projection having an aperture of suitable diameter to receive an end of the guidetube. As shown in FIG. 1, one of the projections is configured such that it bends towards the front surface 11*a* of the sail element while the other projection is configured such that it bends towards the rear surface 11*b* of the sail element. In this manner, the sail structure can be oriented at an angle or pitch in the range of about 10° to about 60°, preferably about 20° to about 45° with respect to the guidetube as shown in FIG. 3. Although the projections 14 can be integral with the sail element 11, the extensions can be attached to the sail element by any conventional means as will be obvious to those skilled in the art. In addition, the projections 14 can be designed in a variety of shapes and sizes in order to achieve particular flight characteristics.

A single guideline 30 having a first end 31 and a second end 32 extends through the guidetube 20. The guideline may be composed of any suitable light-weight material, including for example, cord, wire, string, plastic filament, and the like. Preferably, the guideline is composed of a nylon monofilament such as those used in fishing lines. The guideline may be of any length suitable for the desired operation of the flying toy. In the most basic embodiment, the flying toy of the present invention may be used simply by grasping and/or wrapping each end of the guideline in an operator(s) hand. However, in the embodiment illustrated in FIG. 1, a handle 40 is secured to each end 31, 32 of the guideline in order to facilitate operator(s) manipulation of the flying toy. Preferably each handle contains at least one extension arm 42, or similarly disposed element, for engaging the aerodynamic body 1, thereby causing the aerodynamic body 1 to rotate with the rotation of handle 40. In an alternative embodiment not shown, one or both ends of the guideline may be affixed to a reel mechanism such that the operator(s) of the reel mechanism can select a desired length during play. Such a reel mechanism also will provide for winding of the guideline for easy storage.

Figure 2:
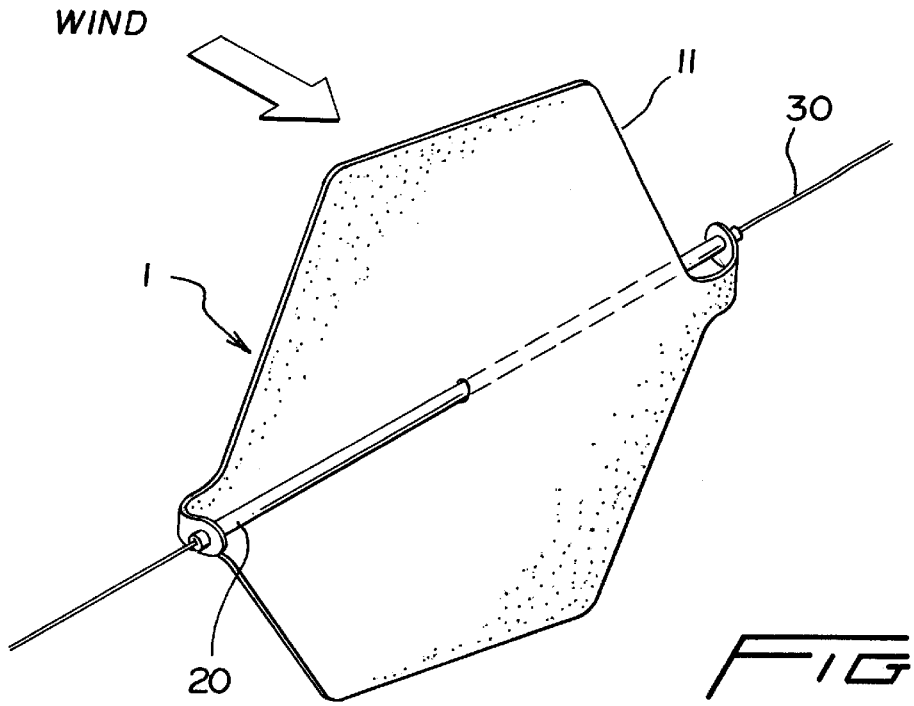
FIG. 2 is a front perspective view of the flying toy of the present invention with its aerodynamic body traversing a guideline in a direction approximately perpendicular to the direction of wind acting upon its sail structure.

The sail element 11 of the present invention is capable of traversing the entire length of the guideline until coming in contact with either the operator's hand or the handle. The direction of travel of the aerodynamic body is dependent upon the direction of the guideline and the orientation of the sail element with respect to the guideline; the direction of the wind power engaging the flying toy is not a factor when the wind direction with respect to the guideline is in the operable range of plus or minus 30° of true perpendicular with respect to the guideline. Increasingly better performance of the flying toy within this operable range is achieved as the wind direction moves closer to true perpendicular. Thus, the operators of the present invention need to position themselves such that the wind direction is within the operable range. In other words, the direction of the aerodynamic body is not dependent upon the direction of the wind when the wind direction is in the operable range, but rather reacts with the wind power. That is not to say that the direction of the wind is without influence; if the wind is blowing in exactly the same direction as the guideline, the aerodynamic body will travel only in the same direction as the wind. Thus, the direction of travel of the aerodynamic body is dependent upon the wind direction only in a limited sense; if the direction of the wind shifts 180°, the aerodynamic body will change directions. For example, as shown in FIG. 2, the aerodynamic body 1 can traverse the length of the guideline in a direction approximately perpendicular to the direction of the wind. Although a wind direction perpendicular to the guideline will result in optimal performance of the flying toy, the guideline does not have to be disposed perpendicular to the direction of the wind in order for the aerodynamic body to travel the guideline in both directions, as long as it is disposed within the operable range. Accordingly, the aerodynamic body of the present invention, reacting with a wind power having a constant and nearly unchanging direction within the operable range, hereinafter referred to as "constant wind direction", is capable of travel in both directions along the guideline. The aerodynamic body, reacting with constant wind direction, is dependent only upon the orientation of the sail element 11 with respect to the guideline and does not require a change in direction of the wind or a change in the operators' position in order for it to change its direction of travel along the guideline.

Figure 4:
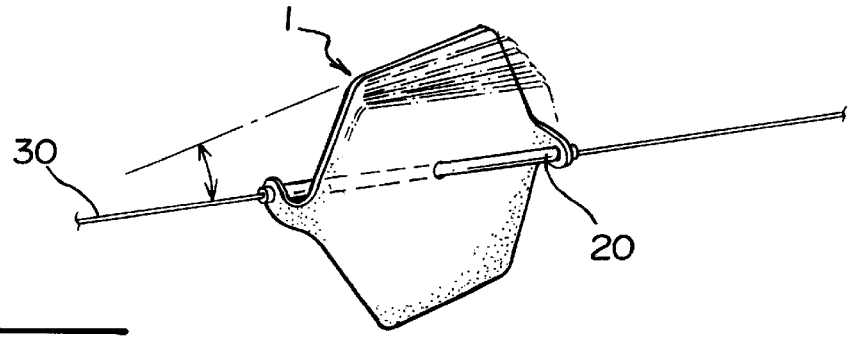
FIG. 4 is a perspective view of the flying toy of the present invention in which the orientation or pitch of the sail structure shown in FIG. 3 has been reversed by "flipping" the sail structure, thereby reversing the direction of travel of the flying toy.

Referring to FIGS. 3 and 4, a 180° rotation of the aerodynamic body 1 with respect to the guideline will cause the pitch or orientation of the aerodynamic body to be reversed, thereby enabling the aerodynamic body to reverse direction. The 180° rotation can be achieved either by manual rotation of the aerodynamic body by an operator, or by rotation of a handle engaging the aerodynamic body. Thus, in operation, when the aerodynamic body 1 has traversed the entire length of the guideline, an operator can rotate the handle engaging the aerodynamic body by 180°, thereby flipping the aerodynamic body and reversing pitch of its sail element 11 with respect to the guideline such that it will traverse the entire length of the guideline, as illustrated in FIG. 4, in the opposite direction. It is not necessary that the aerodynamic body 1 engage an operator's hand or the handle 40 in order to modify its direction of travel along the guideline. Rather, a skilled operator can cause the aerodynamic body 1 to reverse its direction of travel by a variety of means. For example, quickly manipulating the amount of slack in the guideline 30 and/or creating various wave motions or distortions along the length of guideline will induce a flipping motion on the aerodynamic body which will re-orient the pitch of the sail structure with respect to the guideline. Additionally, when the aerodynamic body is in close proximity to the handle or operator's hand, a quick rotating motion of the operator's arm will induce the flipping motion.

Figure 5:
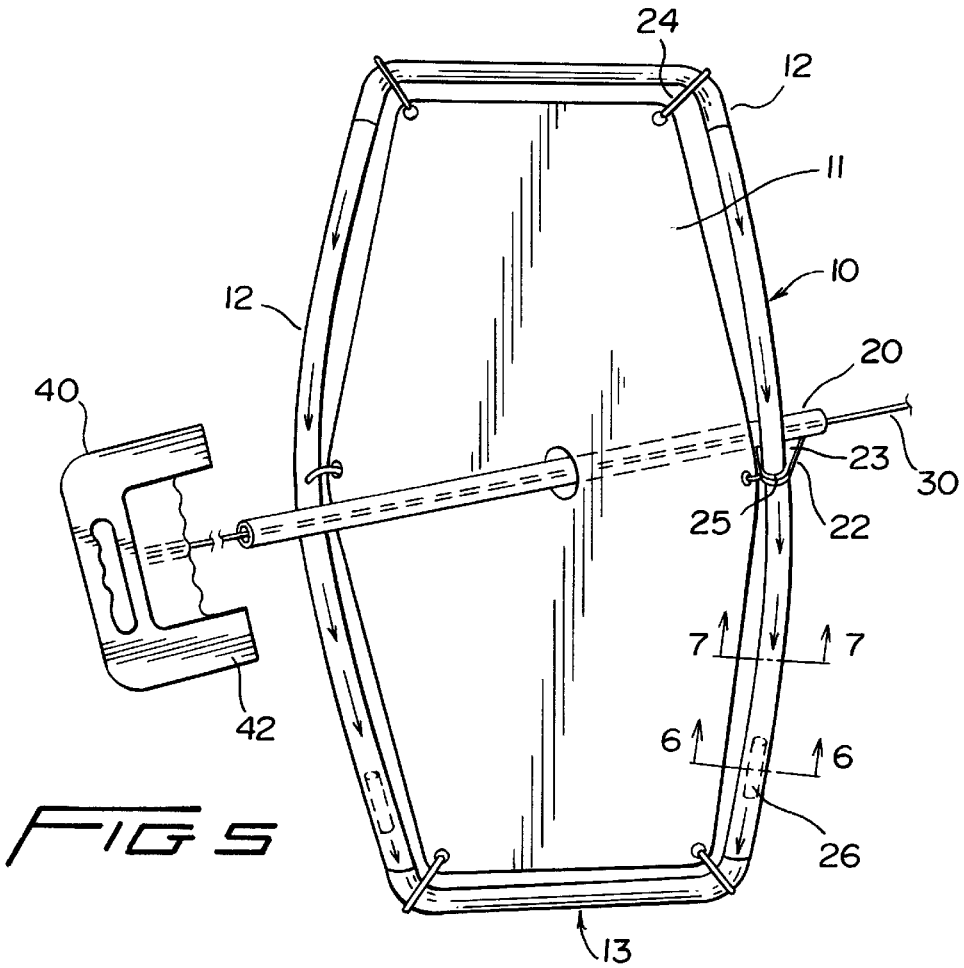
FIG. 5 is a perspective view of alternative embodiment of the flying toy of the present invention, wherein the sail structure includes a frame element and a sail element.

In an alternative embodiment shown in FIG. 5, the sail structure 10 comprises a sail element 11 and a frame element 12. In this embodiment, the guidetube 20 is fastened to the frame element 12 by connecting means 22. The connecting means 22 can be integrally molded with the guidetube 20, such that they are essentially projections 23 extending from each end of the guidetube, or the connecting means can be attached to the guidetube by means well known in the art. As shown in FIG. 5, the connecting means 22 is in the form a projection 23 having an aperture 25 disposed therein, the aperture being of sufficient diameter to receive the vertical frame member 12. The frame element can be composed of any suitable lightweight, rigid and durable material, including for example rigid carbon graphite tubes, fiberglass rods, wood dowels, aluminum or metal alloy tubes, plastic tubes, rods or the like, or may be of a unitary (i.e. one-piece) construction. Preferably, the frame element is composed of rigid carbon graphite tubing. The sail element 11 may be attached to the frame element 12 by any conventional connecting means 24, including for example, cord, O-rings, shock cords, wire, string, rubber bands or the like. Or, the sail element may be fastened directly to the frame element, for example by adhesive, pins and the like. Although the sail structures depicted in FIGS. 1 and 5 have particular design configurations, it is to be understood that the sail structure can have any desired shape, including for example, octagonal, spherical, triangular, pentagonal or novelty shapes, such as animals, fish, cartoon characters, artistic designs and the like.

Figure 6:
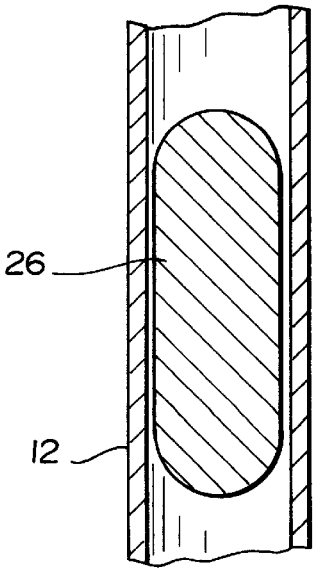
FIG. 6 is sectional view through line 6—6 of FIG. 5 of a stabilizing pin 26 in vertical frame member 12, according to the present invention.

The frame element 12 may be provided with a stabilizing means to maintain the center of gravity of the aerodynamic body in bottom portion 13 of the frame element. For example, referring to FIGS. 5 and 6, when the frame element is composed of tubular members, a stabilizing element 26 may be disposed in one or more of the tubular frame members. Stabilizing element 26 preferably is in the form of a pin; however, any other weighted means is suitable for use as a stabilizing element including for example by granular metal, sand, liquid, disposed within the tubular frame member(s). Due to its weight, the stabilizing element 26 will slide to the bottom of the frame element 12. Thus, whenever the aerodynamic body is rotated 180°, the stabilizing element will slide to the bottom portion 13, thereby maintaining the center of gravity of the aerodynamic body at the bottom portion. The use of the stabilizing element 26 also will eliminate any tendency of the frame element 12 from tipping if it otherwise would be slightly top heavy.

Figure 7:
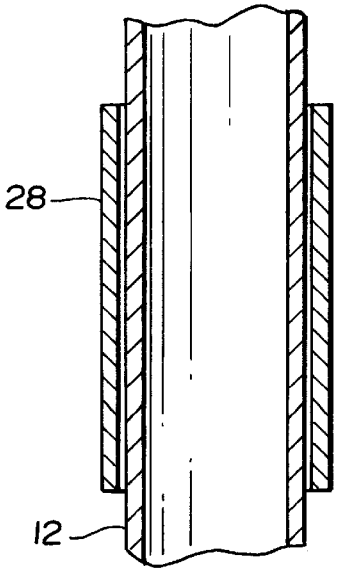
FIG. 7 is a sectional view through line 7—7 of FIG. 5 of a sliding sleeve 28 on vertical frame member 12 as an alternative embodiment to the stabilizing pin 26 shown in FIG. 6.

Rather than utilizing a stabilization element, an alternative stabilizing implementation in the form of a sliding sleeve may be incorporated into flying toy. Referring to FIG. 7, a sliding sleeve 28 is shown in a sectional view. The sliding sleeve is slidably mounted over the tubular frame member in such a manner that it can slide along the tubular frame element 12 thereby performing the same function as stabilizing element 26, namely maintaining the center of gravity of the aerodynamic body in the bottom portion 13 of the frame element 12. Preferably, a plurality of sliding sleeves are slidably mounted over the frame element. The sliding sleeve may be composed of any suitable material, including for example, metal, composite, plastic or other durable, resilient materials. It is to be understood, of course, that other stabilization means to maintain the center of gravity of the aerodynamic body in its bottom portion are contemplated and are to be considered within the scope of the present invention.

Figure 8:
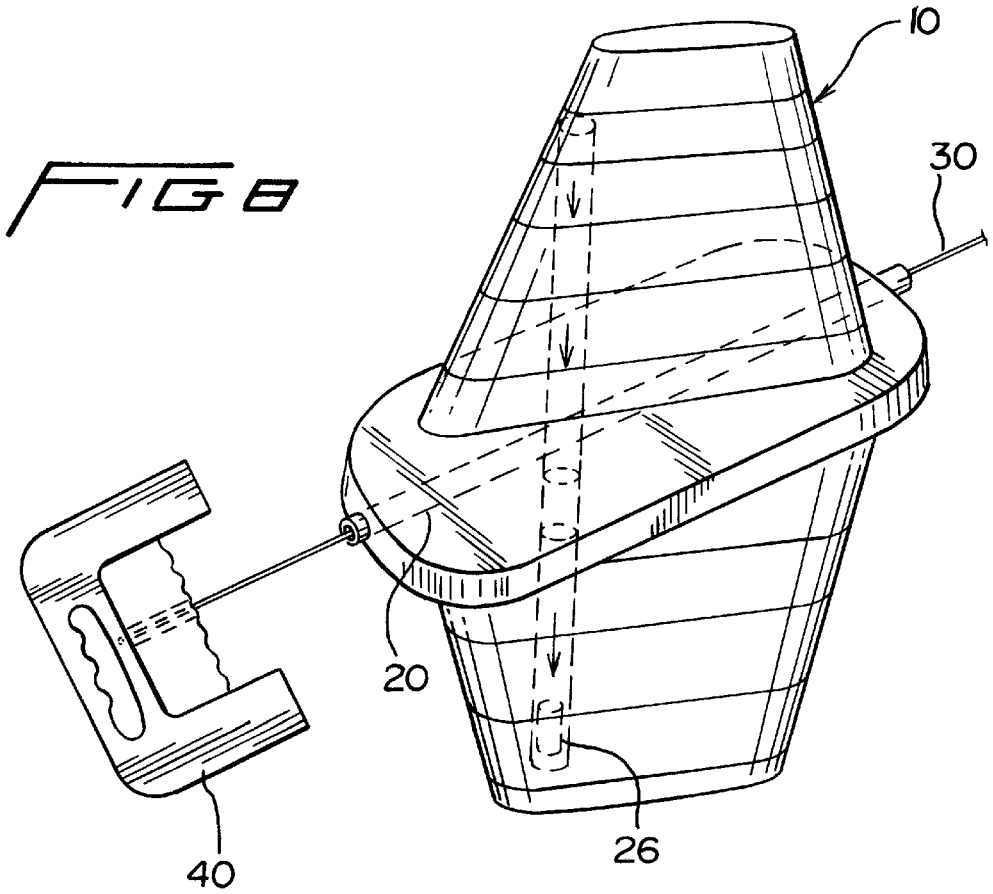
FIG. 8 is a perspective view of an alternate embodiment of the flying toy of the present invention.

In an alternative embodiment as illustrated in FIG. 8, the sail structure 10 of the flying toy of the present invention can be in the form of an aerodynamic body having a three dimensional sail structure having length, width and thickness. Such a three-dimensional sail structure is provided with an aerodynamic surface for reacting with the wind in an efficient manner and is retained at a pitch within the operable range with respect to the guideline as described above. The three dimensional sail structure can be manufactured in any conventional manner as will be well known to those skilled in the art, including for example, injection molded plastic, injection molded foam or vacuum formed plastic. Optionally, a sliding pin 26 can be utilized to further enhance the performance of the aerodynamic body.

Figure 9:
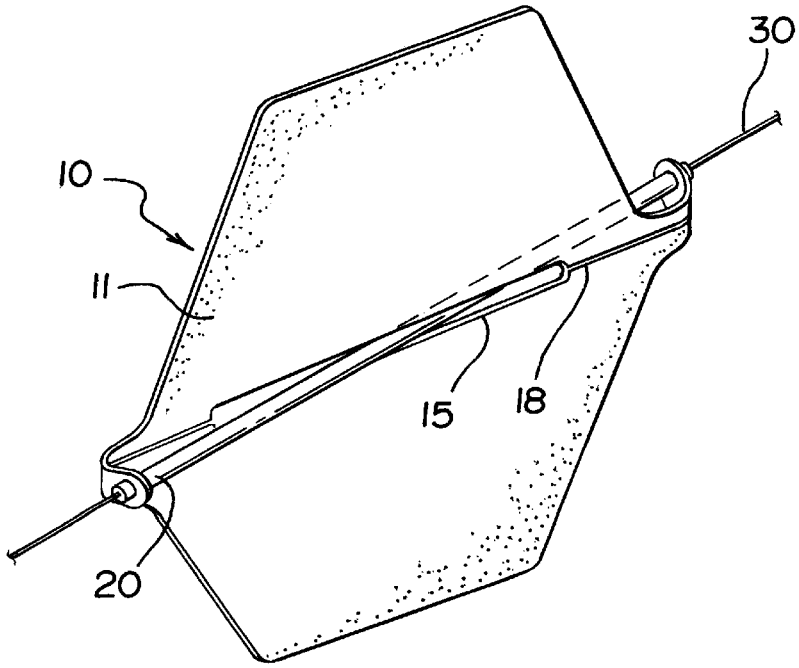
FIG. 9 is a perspective view of the flying toy of the present invention wherein the sail element is provided with an articulation connection.

Sail structure 10 also can be provided with an articulating connection to enhance stability of the aerodynamic body. Referring to FIG. 9, wind pressure causes the articulating connection along horizontal line 18 to flex forming a slight "v" shape between the lower and upper portions of sail structure 10, thereby creating a modified aerodynamic form. Experimentation has shown that this modified form minimizes the rotation of aerodynamic body 1 about the guideline during travel along the guideline. The articulating connection simply may be a crease in the sheet material forming the sail element along the horizontal line 18 as shown in FIG. 9. Alternatively, the articulation function may be in the form of a separate articulating connector joining the upper and lower halves of the sail element. Of course, it is to be understood that other means for providing an articulating connection can be utilized in the flying toy and are to be considered within the scope of the present invention.

Optionally, the sail structure 10 can be provided with an air stabilization channel in order to minimize the rotation of the aerodynamic body about the guideline during travel along the guideline. A suitable air stabilization channel can be any cut out portion of the sail element which extends horizontally across the sail element. For example, referring to FIG. 9, opening 15 is much larger than is required for passage of the guidetube; this elongated opening serves as an air stabilization channel. Experimentation has shown that an air stabilization channel alters the aerodynamic properties of the aerodynamic body in a way that achieves enhanced stability of the aerodynamic body during travel.

As described above, reversal of travel of the aerodynamic body, in the preferred embodiment, is performed by 180° rotation of either a handle or direct or indirect rotation of the aerodynamic body by an operator during operation of the flying toy. In alternative embodiments, the sail element can be pivotally mounted (not shown) with respect to the guideline in order to allow the orientation of the sail structure to be adjusted manually by an operator without having to flip the aerodynamic body. Further, the orientation of the aerodynamic body can be adjusted automatically by utilizing the kinetic energy upon impact of the aerodynamic body at the end of its travel along the length of the guideline. For example, the impact of the aerodynamic body upon contact with a handle or operator's hand can impart a rotational force sufficient for the aerodynamic body to rotate 180° or to automatically adjust the pitch of its sail structure and reverse direction.

In an alternative embodiment, not specifically shown, the flying toy of the present invention may be fabricated from one or more sheets of cardboard material. In such an embodiment, the sail structure essentially can be in the form of a cut-out composed of the cardboard material, such as from the back of a cereal box. A guidetube for the cut-out sail structure could be supplied in the cereal box or could be in the form of a commercially available tubular structure, such as a drinking straw.

Figure 10:
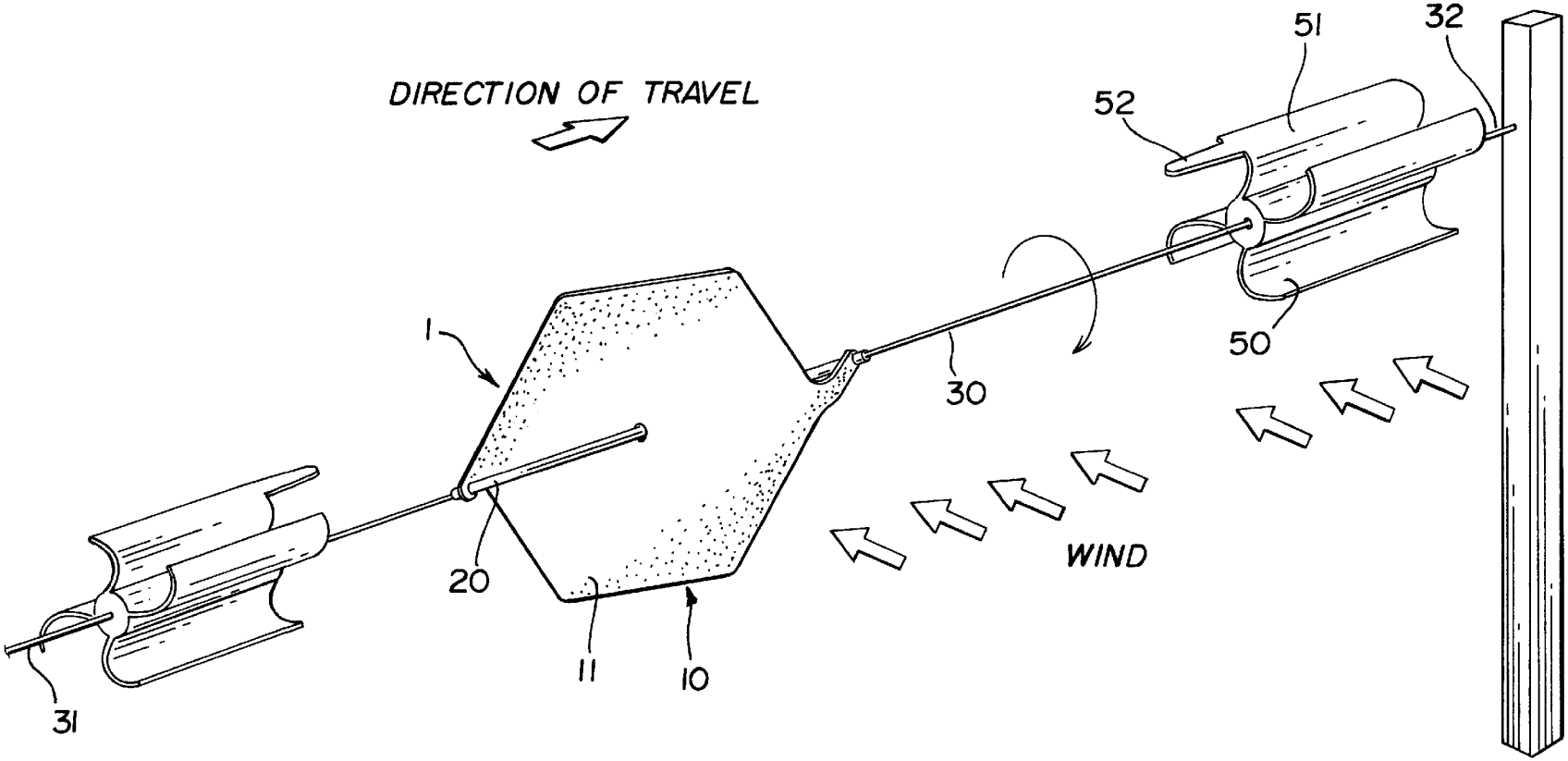
FIG. 10 is an alternative embodiment of the flying toy of the present invention operating in an automatic mode.

In an alternative embodiment illustrated in FIG. 10, the flying toy of the present invention can be in the form of a novelty item which can be operated in an automatic mode, independent of an operator. In this embodiment, a rotatable device 50 is mounted near each end 31 and 32 of the guideline 30 of the flying toy. Each rotating device 50 is provided with means, such as one or more blades 51, which is capable of reacting with the wind in order to cause the rotating device 50 to spin. Preferably, the rotating device 50 includes at least one extension arm 52, or a similarly disposed frictional front surface, for exerting a rotational force on the aerodynamic body 1 upon its impact with the rotating device. While it is preferable for each rotating device to operate under wind power, it is to be understood that the rotating devices can be operated by any suitable means which will create a spinning or rotational motion, including for example, an electrical motor. In addition, although it is preferred that the rotating devices be mounted such that they rotate about the guideline, any other positional arrangement of the rotating devices whereby a rotational force can be imparted to the aerodynamic body during contact with the rotating device is contemplated to be within the scope of this invention. In operation, the aerodynamic body travels the length of the guideline in a first direction, engages the first rotating device, and flips, thereby altering its orientation with respect to the guideline and reversing its direction of travel to the opposite end of the guideline, whereupon it will engage the second rotating device, flip and reverse its direction of travel. In this manner, a continuous "flying" action is provided. This automatic mode of operation not only provides a novelty item, but also can be used as a device for deterring birds or other wild life in gardens or orchards.

In another alternative embodiment, the flying toy of the present invention can be used by only one operator by the use of one rotatable device mounted near one end of the guideline. In this manner, the rotatable device takes the place of the second operator, the aerodynamic body flipping and reversing its direction of travel as it contacts the rotatable device.

While particular embodiments of the invention have been described, it will be understood, of course, that the foregoing detailed description is given merely by way of illustration of the present invention and is not limited thereto, and that many obvious modifications and variations can be made without departing from the spirit of the invention, and that such modifications and variations are intended to fall within the scope of the appended claims. The "Abstract" provided herewith is merely for the convenience of technical searchers and is not to be given any weight with respect to the scope of this invention.

What is claimed is:

1. A wind-driven flying toy comprising:

(a) a flexible guideline having a first end and a second end, said guideline being a single guideline and not more than one guideline; and (b) a wind driven aerodynamic body comprising a sail structure and securing means capable of slidably securing said aerodynamic body to said guideline for linear travel between said ends, said aerodynamic body oriented at a first pitch with respect to said guideline and being capable of traversing said guideline in a first motivating direction toward said first end of said guideline and in a second motivating direction toward said second end of said guideline by reacting with the action of wind against said sail structure when the wind direction is a constant wind direction, said constant wind direction being a wind direction which is about ±30° of true perpendicular with respect to the guideline, wherein, when the orientation of said aerodynamic body is altered from said first pitch to a second pitch, the aerodynamic body reverses its travel from said first motivating direction to said second motivating direction.

2. A flying toy in accordance with claim 1, wherein said securing means is in the form of a guidetube which extends across the sail structure, said guideline extending through said guidetube.

3. A flying toy in accordance with claim 2, wherein said sail structure includes a sail element having an opening disposed therein, said guidetube being connected to said sail structure in such a manner that said guidetube extends across the sail element and through said opening disposed within said sail element.

4. A flying toy in accordance with claim 3, further comprising two complementary projections extending from said sail structure, each projection being configured in such a manner that it is capable of receiving and securing said guidetube thereto.

5. A flying toy in accordance with claim 4, wherein said complementary projections are integral with said sail element.

6. A flying toy in accordance with claim 1, wherein said securing means is in the form of eyelets protruding from said sail structure, said guideline extending through said eyelets.

7. A flying toy in accordance with claim 1, wherein said securing means is in the form of apertures integrally formed within said sail structure, said guideline extending through said apertures.

8. A flying toy in accordance with claim 1, wherein said sail structure is oriented at an angle or pitch in the range of about 10° to about 60° with respect to said guideline.

9. A flying toy in accordance with claim 8, wherein said sail structure is oriented at an angle or pitch in the range of about 20° to about 45° with respect to said guideline.

10. A flying toy in accordance with claim 8, wherein the direction of travel of said aerodynamic body along said guideline can be reversed from said first motivating direction to said second motivating direction by manual adjustment of said pitch of said sail structure.

11. A flying toy in accordance with claim 1, wherein said sail structure is in the form of a sail element.

12. A flying toy in accordance with claim 1, further comprising a first handle attached to said first end of said guideline and a second handle attached to said second end of said guideline.

13. A flying toy in accordance with claim 12, wherein at least one of said first handle and said second handle is provided with a contact surface which exerts a rotational force upon said aerodynamic body when said handle is rotated while in contact with said aerodynamic body.

14. A flying toy in accordance with claim 1, wherein said sail structure further comprises an air stabilization channel.

15. A flying toy in accordance with claim 3, wherein said opening in said sail element for receiving said guidetube is an elongated opening of sufficient length to function as an air stabilization channel.

16. A flying toy in accordance with claim 1, wherein said sail structure comprises a sail element and a frame element, said frame element having a lower portion.

17. A flying toy in accordance with claim 16, wherein said securing means is a guidetube which is connected to said frame element by at least one fastening means.

18. A flying toy in accordance with claim 16, wherein said frame element is provided with at least one slidable weighted stabilizing element to maintain the center of gravity of said aerodynamic body within said lower portion of said frame element.

19. A flying toy in accordance with claim 1, wherein said aerodynamic body is provided with an articulating connection.

20. A flying toy in accordance with claim 1, wherein said sail structure is in the form of an air-filled structure.

21. A flying toy in accordance with claim 7, wherein said aerodynamic body is a unitary sail structure, said apertures being integrally formed therewith.

22. A flying toy in accordance with claim 1, wherein said sail structure is in the form of a three dimensional structure.

23. A wind-driven flying toy comprising:

(a) a flexible guideline having a first end and a second end, said guideline being a single guideline and not more than one guideline;

(b) a wind driven aerodynamic body comprising a sail structure and securing means capable of slidably securing said aerodynamic body to said guideline for linear travel between said ends; and (c) a first handle attached to said first end of said guideline and a second handle attached to said second end of said guideline, said aerodynamic body oriented at a first pitch with respect to said guideline and being capable of traversing said guideline in a first motivating direction toward said first end of said guideline and in a second motivating direction toward said second end of said guideline by reacting with the action of wind in a constant wind direction wherein, when the orientation of said aerodynamic body is altered from said first pitch to a second pitch, the aerodynamic body reverses its travel from said first motivating direction to said second motivating direction.

24. A flying toy in accordance with claim 23, wherein rotating one of said first or second handles by about 180° will cause said aerodynamic body traversing said guideline to flip approximately 180° and change direction from said first motivating direction to said second motivating direction.

25. A flying toy in accordance with claim 23, wherein said sail structure is oriented at an angle or pitch in the range of about 10° to about 60° with respect to said guideline.

26. A flying toy in accordance with claim 25, wherein the direction of travel of said aerodynamic body along said guideline is reversed when said aerodynamic body contacts one of said first handle and said second handle in such a manner that the impact from the contact with the handle will be sufficient for said sail structure to automatically adjust its orientation with respect to said guideline.

27. A wind-driven flying toy comprising:

(a) a guideline having a first end and a second end;

(b) a wind driven aerodynamic body comprising a sail structure and securing means capable of slidably securing said aerodynamic body to said guideline for travel between said ends; and (c) a first wind-driven rotating device connected near to said first end of said guideline, said aerodynamic body being capable of traversing said guideline in a first motivating direction toward said first end of said guideline and being capable of reversing its direction of travel to a second motivating direction toward said second end of said guideline upon contacting said first wind-driven rotating device.

28. A flying toy in accordance with claim 27 further comprising a second rotating device connected near to said second end of said guideline.

29. A flying toy in accordance with claim 28, wherein each of said first rotating device and said second rotating device is provided with spinning means.

30. An automatic flying toy in accordance with claim 29, wherein said spinning means is in the form of at least one blade which is capable of reacting with wind in such a manner that a spinning motion is created.

31. An automatic flying toy in accordance with claim 28, wherein said first rotating device is rotatably mounted to said first end of said guideline and said second rotating device is rotatably mounted to said second end of said guideline.

32. A wind-driven flying toy comprising:

(a) a flexible guideline having a first end and a second end, said guideline being a single guideline and not more than one guideline; and (b) a wind driven aerodynamic body comprising a sail structure slidably secured to said guideline for linear travel between said ends, said sail structure being oriented at an angle of about 10° to about 60° with respect to said guideline, whereby said aerodynamic body is moveable along said guideline when said sail structure reacts with the wind, wherein, when the orientation of said aerodynamic body is rotated about 180°, said aerodynamic body reverses its travel from a first motivating direction to a second opposite motivating direction.

33. A flying toy in accordance with claim 32, further comprising means for adjusting said angle formed by said sail structure with said guideline.

* * * * *